United States Patent [19]

Cunningham et al.

[11] 4,248,314

[45] Feb. 3, 1981

[54] SHAFT DRILL BIT WITH OVERLAPPING CUTTER ARRANGEMENT

[75] Inventors: Robert A. Cunningham, Bellaire; Rudolph C. O. Pessier, West University Place, both of Tex.

[73] Assignee: Hughes Tool Company, Houston, Tex.

[21] Appl. No.: 43,532

[22] Filed: May 29, 1979

[51] Int. Cl.[3] ..... E21B 10/12; E21B 10/16; E21B 10/22; E21B 10/28

[52] U.S. Cl. ..... 175/344; 175/53; 175/376; 175/378

[58] Field of Search ..... 175/344, 376, 378, 390, 175/391, 53

[56] References Cited

U.S. PATENT DOCUMENTS

| | | | |
|---|---|---|---|
| 1,747,909 | 2/1930 | Seifert | 175/344 X |
| 2,949,281 | 8/1960 | Bauer et al. | 175/376 X |
| 3,203,492 | 8/1965 | Lichte | 175/378 X |
| 3,204,710 | 9/1965 | Bechem | 175/344 |
| 3,638,740 | 2/1972 | Justman | 175/344 X |
| 3,726,350 | 4/1973 | Pessier | 175/378 X |
| 3,756,332 | 9/1973 | Crane | 175/376 X |
| 3,762,486 | 10/1973 | Grovenburg et al. | 175/376 X |
| 3,805,901 | 4/1974 | Coski | 175/344 X |

*Primary Examiner*—Stephen J. Novosad
*Attorney, Agent, or Firm*—Robert A. Felsman

[57] ABSTRACT

An earth boring drill bit for large diameter shafts has an improved cutter arrangement. The drill bit has a cutter support member with a number of cutters mounted to it for disintegrating the earth formation face. At least one inner cutter is mounted near the center for cutting the center area. A number of gage cutters are mounted at the periphery to cut the gage area of the shaft. A number of intermediate cutters are spaced between the inner and gage cutters. Each intermediate cutter overlaps one-half of its width with an adjacent intermediate cutter.

8 Claims, 8 Drawing Figures

Fig.2
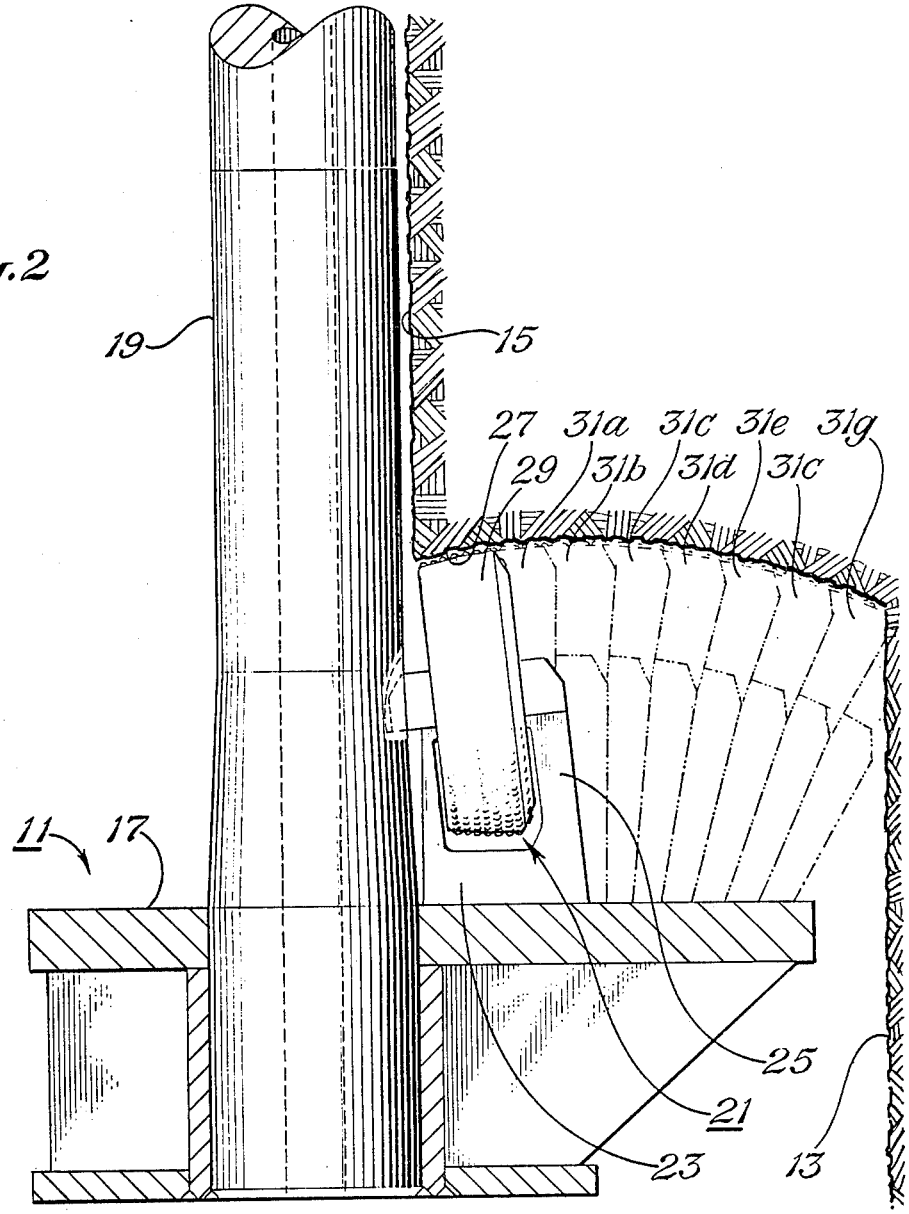
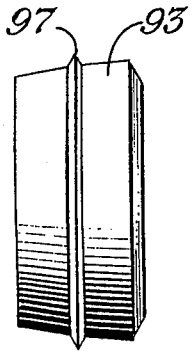
Fig.3
Fig.4
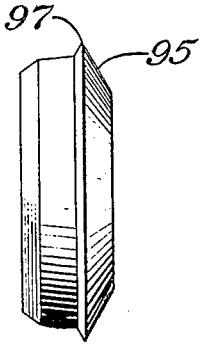

SHAFT DRILL BIT WITH OVERLAPPING CUTTER ARRANGEMENT

BACKGROUND OF THE INVENTION

1. Field of the Invention

This invention relates in general to earth boring drill bits and in particular to a large diameter shaft bit having an improved cutter arrangement.

2. Description of the Prior Art

Drill bits for large diameter shafts normally have a cutter support plate that is connected to a string of drill pipe for rotation. A number of cutter assemblies are secured to the cutter support plate to disintegrate the earth as the cutter support plate is rotated. The drilling may be downward, or upward by pulling the bit through a pilot hole, as shown in U.S. Pat. No. 3,805,901.

Normally the cutters are arranged to cut separate paths, although two or more cutters may be located in the same path for more effective earth disintegration. If two or more cutters are located in the same path, they must have different insert spacing patterns to avoid tracking. "Tracking" is a condition which results when a cutter tooth engages a previously made depression in a borehole bottom or face. As a result, a crest of rock may be generated on the face, which may lead to disadvantages such as erosion of the cutter shell or premature tooth disintegration. The different insert patterns require additional inventory and costs.

Another disadvantage of prior art drill bits is that the bit bodies may not be used both for tooth cutters and for discs. A disc cutter has a sharp circumferential ridge, rather than individual teeth. The best disc cutters utilize only a single ridge, since it has been found that double ridge disc cutters wear faster than single ridge cutters. However, the bearing and seal requirements normally require a fairly wide mounting bracket for tooth cutters. Mounting a single disc in a wide mounting bracket would place the disc too far from adjacent discs for the desired spacing.

SUMMARY OF THE INVENTION

It is accordingly a general object of this invention to provide an improved earth boring drill bit for cutting large diameter shafts.

It is a further object of this invention to provide an improved earth boring drill bit for cutting large diameter shafts that has an improved cutter arrangement for more effectively disintegrating the earth face.

It is a further object of this invention to provide an improved earth boring drill bit for cutting large diameter shafts that has a cutter arrangement that allows single disc cutters to be interchanged with tooth cutters, without sacrificing disc spacing.

In accordance with these objects, a drill bit is provided that utilizes intermediate cutters that are mounted to overlap half of the path of the intermediate cutter next to it. Each intermediate cutter has an angle break substantially at its mid-point, with preferably different insert patterns on one side than the other. Also the cutters are mounted so that the rows of inserts of the overlapping cutter fall in the space between the rows of inserts of the other cutter in that path. One intermediate cutter overlaps the path of the gage cutters, which are preferably one-half the width of the intermediate cutters. In the case of a raise drill reamer, the inner cutter is also overlapped by an intermediate cutter and is also one-half the width of the intermediate cutter. The overlapping of one-half of each intermediate cutter divides the spacing for a disc cutter into half.

BRIEF DESCRIPTION OF THE DRAWINGS

FIG. 2 is a partial vertical sectional view of the drill reamer of FIG. 1, with the cutter assemblies shown rotated into the plane of the section, in phantom, to show their relative positions.

FIGS. 3 and 4 are discs that can be utilized in place of the cutters of FIG. 1, if desired.

DESCRIPTION OF THE PREFERRED EMBODIMENT

Figure 1:
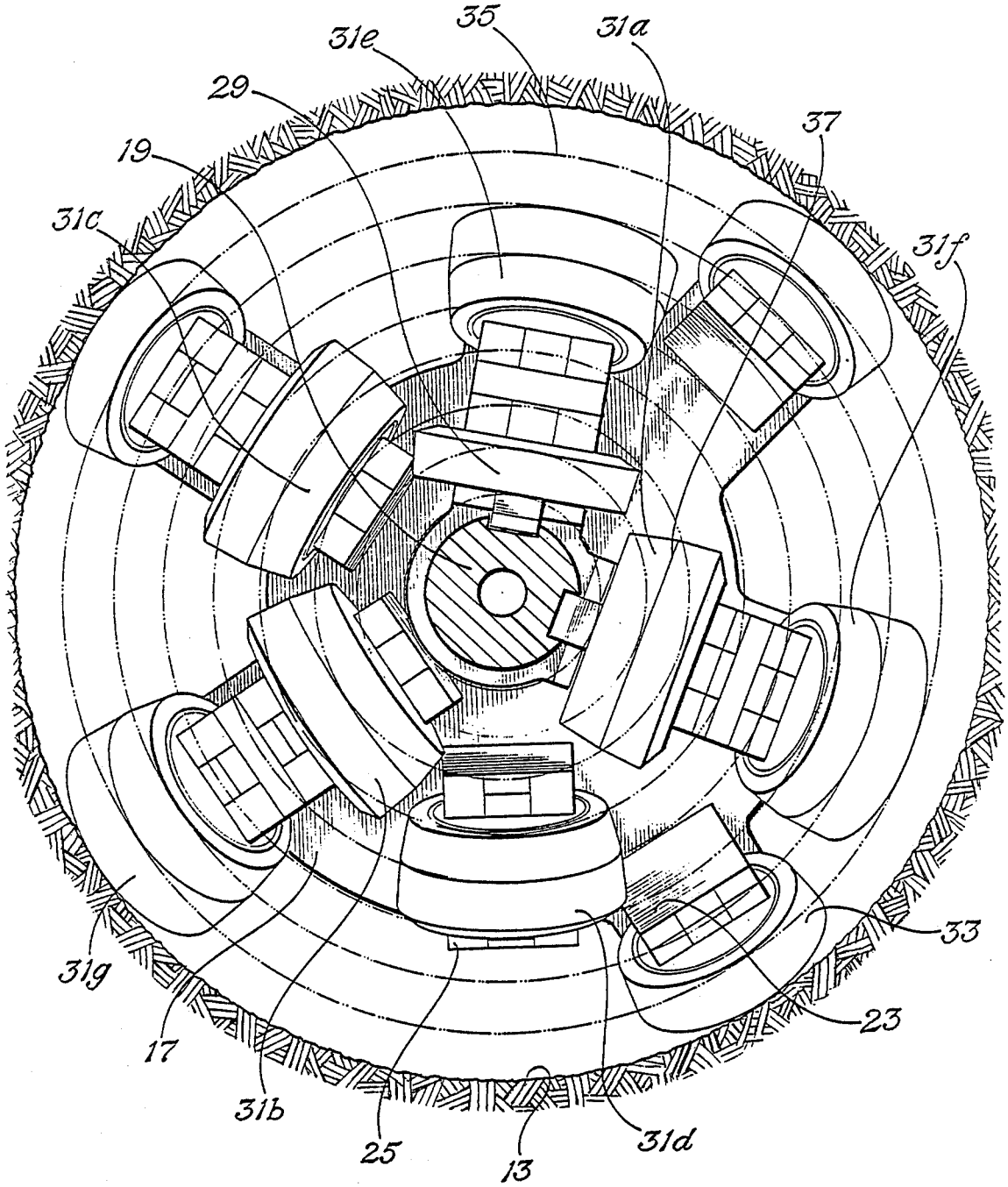
FIG. 1 is a top plan view of a raise drill reamer having cutter assemblies in accordance with this invention.

Referring to FIG. 2 a raise drill bit or reamer 11 is shown boring a shaft 13, it being drawn upward through a previously drilled pilot hole 15. Raise drill reamer 11 includes a cutter support member or plate 17 secured to a cylindrical stem 19 in the plate's axis of revolution and normal to the plate. Stem 19 is secured to drill pipe (not shown). A plurality of cutter assemblies 21 are mounted to the plate 17 by cutter mounts 23. Each cutter mount 23 has two arms 25 spaced apart from each other and facing away from the cutter support plate 17. Arms 25 define a saddle or cradle for receiving the cutter assembly 21. Each cutter assembly 21 is rotatable on its own axis, each axis lying generally in a vertical radial plane that contains the axis of rotation of cutter support plate 17, as can be seen in FIG. 1. Rotation of cutter support plate 17 by the drill pipe rotates the cutter assemblies 21 in annular paths to disintegrate the earth formation face 27. The term "borehole bottom," will be used interchangably with the "earth formation face" although in raise drilling, the face 27 is actually the upper portion of shaft 13.

Cutter Assembly Placement

Referring to FIG. 1, cutter assemblies 21 include an inner cutter 29, seven intermediate cutters 31, designated 31*a* through 31*g*, and three outer or gage cutters 33. The inner cutter 29 and the gage cutters 33 are approximately one-half the width of the intermediate cutters 31. The inner cutter 29 and gage cutters 33 have reinforcements on the inside cutting row and the outside or heel cutting row for cutting the pilot hole 15 (FIG. 2) and gage areas. The phantom lines 35 indicate the paths, or the annular areas of earth from the borehole bottom that the various cutters remove.

Figure 5:
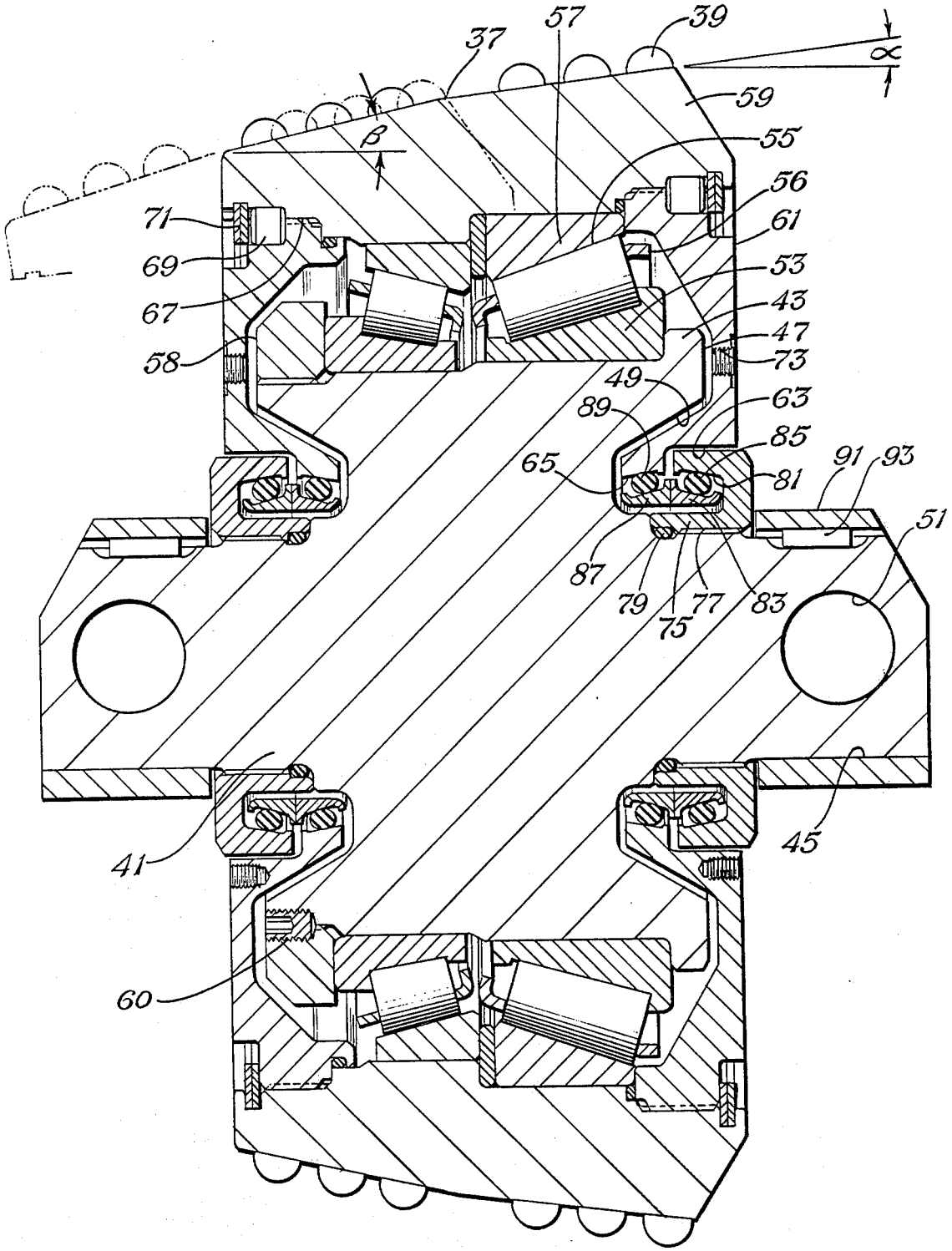
FIG. 5 is a vertical sectional view of one of the cutters of FIG. 1, with the next inward cutter shown partially in phantom and rotated into the plane of the section.

The inner cutter 29 is mounted adjacent the stem 19 for cutting the edge of the pilot hole 15 (FIG. 2). The innermost intermediate cutter 31*a* has its inner edge located the same distance from stem 19 as the inner edge of inner cutter 29. One half of intermediate cutter 31*a* overlaps the entire path of inner cutter 29. The next outward intermediate cutter 31*b* has its inner edge the same distance from the axis of revolution of the cutter support plate 17 as the midpoint 37 on the innermost intermediate cutter 31*a*. This causes the inner half of intermediate cutter 31*b* to fully overlap the outer half of intermediate cutter 31*a*. The outer edge of intermediate cutter 31*b* is the same distance from the center of the cutter support plate 17 as the midpoint 37 of intermediate cutter 31*c*. As shown in FIG. 5, "outer edge" refers to the outer edge of the heel row of inserts 39. The outer half or portion of intermediate cutter 31*c* fully overlaps with the inner half or portion of intermediate cutter 31*d*. The outer portion of intermediate cutter 31*d* fully overlaps with the inner portion of intermediate cutter 31*e*. The outer portion of intermediate cutter 31*e* fully overlaps with the inner portion of intermediate cutter 31*f*. The outer portion of intermediate cutter 31*f* fully overlaps with the inner portion of intermediate cutter 31*g*. The outer portion of intermediate cutter 31*g* fully overlaps the paths of the three gage cutters 33.

Referring to FIG. 5, midpoint 37 is also the location of an angle break between the inner and outer halves of each cutter assembly 21. Both the outer portion and the inner portion define frusto-conical surfaces that taper inwardly. The outer portion tapers at an angle $\alpha$ with respect to the axis of rotation of the cutter shell 59. The inner portion tapers inwardly at a greater angle $\beta$ with respect to the axis of rotation of the cutter shell 59. Preferably, the angle $\alpha$ is $7\frac{1}{2}$ degrees, while the angle $\beta$ is $12\frac{1}{2}$ degrees. Each portion cuts a plane surface. As shown in FIG. 2, the arms 25 of each cutter mount 23 are oriented to make a contour from the pilot hole 15 to the wall of shaft 13. Each path is a frusto-conical surface that inclines at a different angle, with respect to the plate 17, than adjacent paths, to create the contour. As shown by the phantom lines in FIG. 5, each intermediate cutter is oriented by its cutter mount so that the angle of inclination of its outer portion is approximately the same as the inner portion of the next outward cutter, with respect to cutter support plate 17.

As shown in FIG. 5, each cutter assembly 21 contains a plurality of rows of tungsten carbide inserts 39, which are interferingly secured in mating holes in the exterior of the cutter. The intermediate cutters 31 have three circumferential rows in the outer portion, and three circumferential rows in the inner portion. As will be explained hereinafter, the pattern of the inserts on the inner portion is preferably distinctly different from the pattern of the inserts on the outer portion. Also, as shown by the phantom lines in FIG. 5, the cutter mounts 23 are laterally offset one-half insert width. This causes the rows of inserts of an overlapping cutter to contact the earth face in the spaces between where the rows of inserts of the overlapped cutter contact. This pairing of cutters so that their rows contact different portions of the earth face results in close spacing of depressions on the earth face.

FIG. 3 illustrates a disc cutter 93 of the same width as the intermediate cutters 31, and for interchanging on the cutter mounts 23 for the intermediate cutters 31. FIG. 4 discloses a disc cutter 95 of the same width as the inner cutter 29 and the gage cutters 33, and for interchanging on the cutter mounts 23 for the inner and gage cutters. Both disc cutters 93 and 95 have smooth circumferential surfaces except for a single ridge 97 for disintegrating the earth formation face. Ridge 97 is in the center of cutter 93. Cutter 95 can be reversed so that ridge 97 will be located on the outer edge for the gage and on the inner edge for the cutter adjacent the pilot hole, as shown in FIG. 8.

Figure 8:
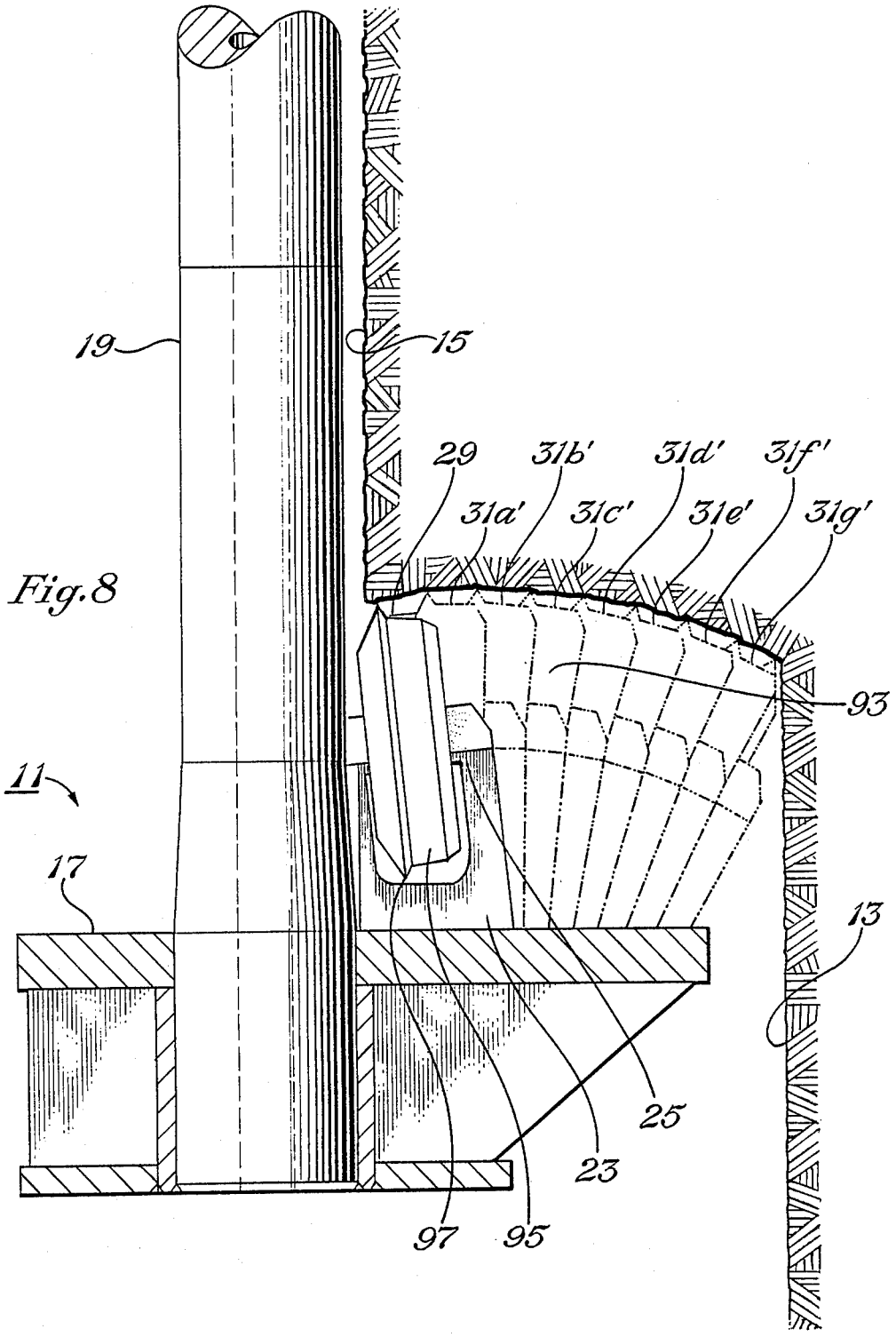
FIG. 8 is a view of the drill reamer of FIG. 1 similar to the view shown in FIG. 2, but with the disc cutters of FIGS. 3 and 4 mounted to the bit body rather than toothed cutters.

If the intermediate cutters 31 cover two three inch paths, the paths of the ridges 97 will be only three inches apart because of the overlapping as shown by FIG. 8, and by reference to FIG. 1. For example, the ridge 97 for cutter 31*c* is only one-half cutter's width further outward than the ridge 97 for cutter 31*b*. Without the overlapping arrangement shown in FIG. 1, two discs would have to be placed on a six inch cutter in order to achieve three inch spacing. This allows the same bit body to be used both for cutters having earth disintegrating teeth and for disc cutters.

Bearing and Seal Arrangement

Referring again to FIG. 5, each cutter assembly 21 includes an axle 41. Axle 41 has a generally cylindrical enlarged central portion 43 and reduced cylindrical portions 45 on both sides. Shoulder 47 separates the enlarged portion 43 from the reduced portions 45. A recess 49 is formed in the shoulder 47. Recess 49 has an inner diameter slightly greater than the diameter of the reduced portion 45, and an outer diameter about three-fourths the smallest diameter of the central portion 43. Reduced portions 45 both contain passages 51 for connection to the arms 25 of the cutter mounts 23.

Two inner bearing races 53 are fitted over the central portion 43 of axle 41. The larger inner bearing race is on the outer side of cutter assembly 21. A plurality of tapered roller bearings 55 are carried on the outer surface of inner race 53, retained by a cage 56 and outer race 57. A cutter shell or sleeve 59 fits tightly over the two outer races 57. Threaded ring 58 secures and preloads the bearing assemblies, with set screw 60 preventing rotation once ring 58 is tightened. The outer races 57, cage 56, rollers 55, and inner races 53 serve as bearing means for rotatably supporting the cutter shell 59 for rotation with respect to axle 41. Axle 41 serves as axle means for rotatably carrying cutter shell 59. An annular member 61 is rigidly secured to cutter shell 59 for rotation therewith. Annular member 61 has an axial bore 63 through which a reduced portion 45 protrudes. Annular member 61 has a smooth outer face flush with the sides of cutter shell 59, and a concave interior face, that has a portion extending into recess 49. Axial bore 63 has a seal seat 65 formed on it within the portion that fits in recess 49. Each annular member 61 is secured to cutter shell 59 by threads 67, backed up by a dowel pin 69 and retainer ring 71. Each annular member 61 also has a threaded socket 73 for securing a tool for assembling.

Seal means is mounted between each reduced portion 45 and each seal seat 65 for preventing the ingress of grit into the bearing means. The preferred seal means is of the type known as "Caterpillar" seal and is shown in U.S. Pat. No. 3,612,196. The seal means includes a seal cage 75 secured by threads 77 to a reduced portion 45. An O ring 79 prevents ingress of fluids through the threads. Seal cage 75 is an annular channel member, with the channel 81 facing toward the interior. A fixed seal ring 83 fits inside channel 81, compressing a resilient O ring 85 between it and the channel 81. Seal ring 83 is metallic and has a metallic face facing toward the interior. A rotating seal ring 87 is located within the recess 49, compressing a resilient O ring 89 between it and seal seat 65. Rotating seal ring 87 rotates with cutter shell 59, with its face in sliding contact with the face of the fixed seal ring 83. A square sleeve 91 is secured over each reduced portion 45 by a key 93, for mounting within arms 25.

As is apparent in the figure, the diameter of the seal means is considerably less than the diameter of the axle central portion 43 and inner diameter of either inner bearing race 53. In the preferred embodiment, the outer diameter of the metallic faces of seal rings 83 and 87 is about $4\frac{5}{8}$ inch, while the inner diameter of the smaller bearing race 53 is about $7\frac{5}{8}$ inch. This allows a large diameter bearing, with a seal means of smaller diameter to reduce surface velocity and heat. Also, the recess 49 accommodates more than half of the width of the seal means, allowing a reduced overall cutter width. In the preferred embodiment, the seal means is about $1\frac{5}{8}$ inch wide, and about $1\frac{1}{8}$ inch of it is received within recess 49. Also, the distance between the seal means on one side to the seal means on the other side is less than the width of the two inner bearing races 53.

Insert Placement

Figure 7:
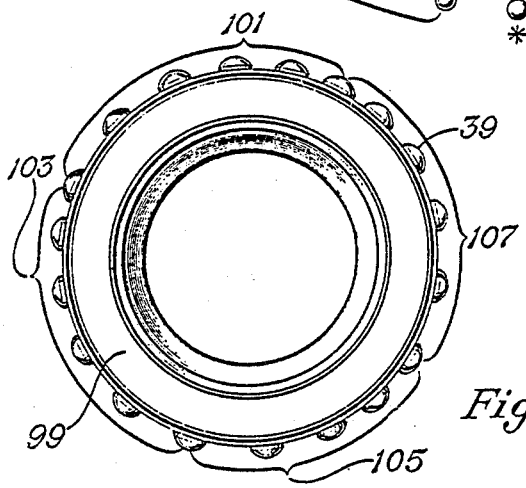
FIG. 7 is an end view of a cutter illustrating the principle of the insert spacing shown in the layout of FIG. 6.

Referring to FIG. 7, a side elevational view of a cutter shell 99 is shown with a single row of inserts 39. Cutter shell 99 illustrates both a cutter for a shaft drill bit as shown in the other figures, and a cutter for a three cone bit such as is shown in U.S. Pat. No. 3,727,705. Inserts 39 are grouped into four separate groups, indicated as 101, 103, 105, and 107. Within each group, the pitch varies. The pitch is defined herein as the distance between the center lines of adjacent inserts of a circumferencial row, measured generally between the intersections of the center lines with the surface of the cutter shell that supports the inserts. In group 101, the pitch gradually increases in a counterclockwise direction. Group 103 is identical to group 101, the pitch gradually increasing. Group 105 immediately follows group 103 and has decreasing pitch. Group 107 immediately follows group 105 and has decreasing pitch.

The amount of increase in pitch, decrease in pitch and the number in each group are selected according to several criteria. First, there is a minimum pitch determined by the necessary cutter shell metal needed to hold the insert in place. The maximum amount of pitch is determined by the extent a typical earth formation is disturbed by a single insert. This normally will be somewhat greater than the diameter of the insert 39 and depends also on the cutter circumference and amount the insert protrudes from the cutter shell exterior.

The number of inserts within the group depends upon the desired change from insert to insert. To have an appreciable difference between the pitch from one insert to its adjacent inserts, generally groups from about three to seven inserts are used. To calculate the precise position, the number of spaces between inserts in the group, less one, is divided into the total increase in pitch. This constant number is allotted to each space between inserts in the group. Consequently, in an increasing group, any space between insert centerlines will be the same as the preceeding space in the group plus the constant number. In a decreasing group, any space between insert centerlines will be the same as the preceding space less the constant number. Preferably the same maximum and minimum are used for each group within a single row.

Figure 6:
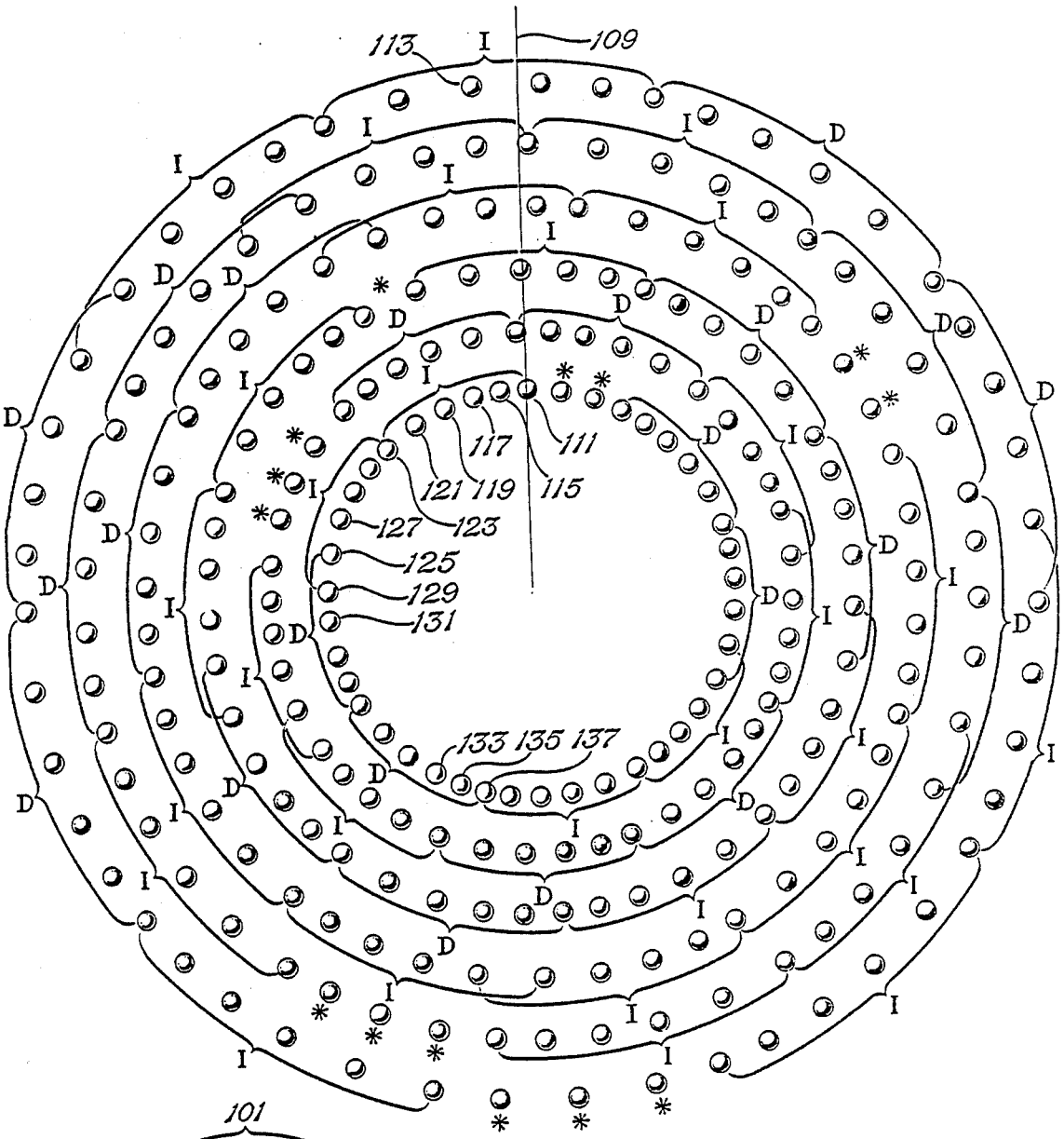
FIG. 6 is a schematic layout, showing a preferred insert spacing arrangement for the cutter of FIG. 1.

By way of example, FIG. 6 illustrates spacing for the six rows of the cutter shown in FIG. 5. "Spacing" of inserts relates to the angular measure between teeth. All of the inserts within a single row are at the same distance from the edge of the cutter. The smallest diameter row, as shown in FIG. 6, is the innermost row, which is the one shown on the left in FIG. 5. The largest diameter row shown in FIG. 6 is the outermost row or the one on the right, as shown in FIG. 5. The diameter of the cutter shell 59 does not vary as much as the relative diameters between row 1 and row 6 as shown in the spacing diagram of FIG. 6. However, the particular angle at which one of the inserts lies, with respect to the reference line 109, will be the actual point where the insert is placed in the cutter shell 59. For example, in row 1, the first insert 111 is shown at zero degrees. The insert 113 of row 6 is shown at about first degrees, and on the cutter shell 59, insert 113 will be five degrees, rotationally, from insert 111.

As shown by the bracket indicators in FIG. 6, each row is divided into eight or more groups, with the groups marked "I" having increasing pitch and the groups marked "D" having decreasing pitch, as viewed counterclockwise. The inserts marked with an asterisk are inserts for filling the space between the first group in a row and the last full group. The pitch in the leftover group preferably varies also, generally increasing or decreasing according to what would normally occur in the cycle.

Each group, except the leftover group, contains six inserts, yielding five spaces between inserts for varying. For example, if the minimum pitch selected is 0.875 inch for row 1, and a maximum pitch selected is 1.337 inch, the difference between the two is 0.462 inch. Divided by four spaces, this yields a constant number of about 0.115 inch for each space between centerlines. The distance between the centerlines of insert 111 and insert 115 at the intersection with the cutter shell is 0.875 inch, which transcribes to about seven degrees from reference 109. Between the centerlines of insert 115 and insert 117, the distance is the sum of 0.875 inch plus 0.115, yielding 0.990 inch. This places insert 117 slightly more than 15 degrees from the reference 109. Between the centerlines of insert 117 and insert 119, the distance is 0.990 inch plus 0.115 equalling 1.105 inch, and placing insert 119 at about 23 degrees. Between the centerlines of insert 119 to insert 121, the distance is 1.105 plus 0.115, equalling 1.220 inch, and placing insert 121 at about 33 degrees. Between the centerlines of insert 121 and inert 123, the distance is 1.220 plus 0.115 inch, equally 1.335, and placing insert 123, at about 44 degrees. The other increasing groups are calculated exactly in the same manner.

Insert 123 is the first insert in the second group, as well as the last insert in the first group. The first insert 125 in the first decreasing group is also the fifth insert in the second increasing group. The distance to the preceeding insert 127 centerline is 1.220 inch and to the succeeding insert 129 centerline is 1.335 inch. The distance from the centerline of insert 129 to the centerline of the next insert 131 is 1.335 minus 0.115 inch or 1.220 inch. The decreasing groups are calculated in reverse to the increasing groups. The reason that a decreasing row overlaps one insert with an increasing row, when following it, is to avoid having two maximum pitches next to each other. When cycling from the second decreasing group to the first increasing group, overlapping can be avoided since the pitch is at a minimum. For example, the distance from the centerlines of insert 133 and insert 135 is the minimum of 0.875 inch for the last insert of a decreasing group. The distance from the centerlines of inserts 135 and 137 is also 0.875 inch, for the first of an increasing group. Insert 135 is the only insert of row 1 that has the same pitch on one side as on the other side.

The other rows are calculated in the same manner, except since the cutter shell circumference is larger, the maximum and minimum pitches may be different. Also, the groups are not started at the same point. In the preferred embodiment, row 2 commences the same pattern as row 1, but at 82 degrees; row 3 commences the same pattern as row 1 at 29 degrees; row 4 commences the same type of pattern as row 1 at 312 degrees; row 5 commences the same type of pattern as row 1 at 174 degrees; and row 6 commences the same type of pattern as row 1 at 200 degrees, all with reference to the line 109. Consequently, the pattern of the rows of inserts on the inner three rows of a cutter assembly 21 will be distinctly different from the spacing of the three rows on the outer portion of the cutter assembly 21.

It should be apparent that an invention having significant advantages has been provided. By overlapping and providing two distinctly different cutting arrangements on each half of the intermediate cutters, tracking can be reduced. The overlapping and angle breaks reduce ridge buildup between paths. Expensive reinforcements necessary for gage and pilot hole cutting can be placed only on the shorter width cutters. Gage cutters, on which only the heel row inserts are damaged, can be re-used next to the pilot hole. If higher unit loads are desirable to increase penetration rate and reduce cutter costs, alternate cutters can be removed without sacrificing borehole coverage. The overlapping makes it possible to provide single disc cutters on a three inch spacing with a bit body for six inch spacing tooth cutters.

While the invention has been shown in only one of its forms, it should be apparent to those skilled in the art that it is not so limited, but is susceptible to various changes and modifications without departing from the spirit thereof.

I claim:

1. An earth boring drill bit, comprising in combination:

a cutter support member adapted to be connected to a string of drill pipe for imparting rotary drive to the cutter support member;

at least one inner cutter rotatably mounted to the cutter support member adjacent the center for disintegrating the earth formation face in the vicinity of the center;

a plurality of gage cutters rotatably mounted at the periphery of the cutter support member for disintegrating the earth formation face in the gage vicinity; and a plurality of intermediate cutters rotatably mounted to the cutter support member between the inner cutter and the gage cutters at regular intervals, the intermediate cutters each having a plurality of rows of inserts for disintegrating the earth formation face in the vicinity between the center and the gage areas; each intermediate cutter being positioned so that it overlaps one-half of the next outward intermediate cutter;

the intermediate cutters being offset so that the rows of inserts of an overlapping cutter contact the earth between the points where the rows of the inserts of the overlapped cutter contact.

2. An earth boring drill bit, comprising in combination:

a cutter support member adapted to be connected to a string of drill pipe for imparting rotary drive to the cutter support member;

at least one inner cutter rotatably mounted to the cutter support member adjacent the center for disintegrating the earth formation face in the vicinity of the center;

a plurality of gage cutters rotatably mounted at the periphery of the cutter support member for disintegrating the earth formation face in the gage vicinity; and a plurality of intermediate cutters rotatably mounted to the cutter support member between the inner cutter and the gage cutters at regular intervals for disintegrating the earth formation face in the vicinity between the center and the gage areas; each intermediate cutter being positioned so that it overlaps one-half of the next outward intermediate cutter;

each intermediate cutter being divided at its midpoint into an inner portion and an outer portion, each said portion having a pattern of inserts thereon, the pattern of the inserts on the inner portion distinctly differing from the pattern of the inserts on the outer portion.

3. An earth boring drill bit comprising in combination:

a cutter support member adapated to be connected to a string of drill pipe for imparting rotational motion to the cutter support member;

at least one inner cutter mounted to the cutter support member adjacent the center for disintegrating the earth formation face in the vicinity of the center;

a plurality of gage cutters, mounted at the periphery of the cutter support member, for disintegrating the earth formation in the vicinity of the gage, all of the gage cutters being located the same distance from the center of the cutter support member;

a plurality of intermediate cutters mounted to the cutter support member between the inner cutter and the gage cutters at regular intervals for disintegrating the earth formation face in the vicinity between the center and the gage areas, the outer edge of each intermediate cutter being located the same distance from the center of the cutter support member as the midpoint of the next outward intermediate cutter, all of the intermediate cutters being the same width, the outer edge of the outermost intermediate cutter being the same distance from the center of the cutter support member as the outer edges of the gage cutters, the gage cutters being one-half the width of the intermediate cutters.

4. An earth boring drill bit, comprising in combination:

a cutter support member adapted to be connected to a string of drill pipe for imparting rotary motion to the cutter support member;

at least one inner cutter mounted to the cutter support member adjacent the center for disintegrating the earth formation face in the vicinity of the center;

a plurality of gage cutters mounted at the periphery of the cutter support member, each having a plurality of hard metal inserts for disintegrating the earth formation face in the vicinity of the gage, all of the gage cutters being located the same distance from the center of the cutter support member and all being identical;

a plurality of intermediate cutters mounted to the cutter support member between the inner cutter and the gage cutters at regular intervals, each having a plurality of hard metal inserts for disintegrating the earth formation face in the vicinity between the center area and the gage area, the outer edge of each intermediate cutter being located the same distance from the center of the cutter support member as the midpoint of the next outward intermediate cutter, the outer edge of the outermost intermediate cutter being the same distance from the center of the cutter support member as the outer edges of the gage cutters, all of the intermediate cutters being the same width and twice as wide as the gage cutters, the inserts on one side of the midpoint of each intermediate cutter having a distinctly different pattern than the inserts on the other side of the midpoint.

5. An earth boring drill bit, comprising in combination:

a cutter support member adapted to be connected to a string of drill pipe for imparting rotary motion to the cutter support member;

at least one inner cutter mounted to the cutter support member adjacent the center for disintegrating the earth formation face in the vicinity of the center;

a plurality of gage cutters mounted at the periphery of the cutter support member, each having a plurality of hard metal inserts for disintegrating the earth formation face in the vicinity of the gage, all of the gage cutters being located the same distance from the center of the cutter support member and all being identical;

a plurality of intermediate cutters mounted to the cutter support member between the inner cutter and the gage cutters at regular intervals, each having a plurality of hard metal inserts for disintegrating the earth formation face in the vicinity between the center area and the gage area, the outer edge of each intermediate cutter being located the same distance from the center of the cutter support member as the midpoint of the next outward intermediate cutter, the outer edge of the outermost intermediate cutter being the same distance from the center of the cutter support member as the outer edge of the gage cutters, all of the intermediate cutters being the same width and twice as wide as the gage cutters, the rows of inserts on the intermediate cutters being offset so that the rows of inserts of an overlapping cutter contact the earth between the points where the rows of the inserts of the overlapped cutter contact;

each intermediate cutter being divided at its midpoint into an inner portion and an outer portion, both of which are frusto-conical surfaces tapering inwardly, the inclination of the inner portion being at a greater degree of inclination than the outer portion with respect to the cutter axis of rotation, the pattern of the inserts on the outer portion differing from the pattern of the inserts on the inner portion.

6. A raise drill reamer adapted for drilling a bore in earth formation 8 by being rotated and drawn upward by a string of pipe extending through a pilot hole, comprising in combination:

a cutter support member having a stem secured to its center of rotation and extending upwardly for connection to a string of drill pipe;

an inner cutter rotatably mounted to the cutter support member adjacent the stem for disintegrating the earth formation face in the vicinity of the pilot hole;

a plurality of gage cutters rotatably mounted to the cutter support member at the periphery for disintegrating the earth formation face in the vicinity of the gage;

a plurality of intermediate cutters rotatably mounted to the cutter support member between the inner cutter and the gage cutters at regular intervals for disintegrating the earth formation face in the vicinity between the pilot hole area and the gage area; each intermediate cutter being twice the width of the inner cutter and each gage cutter, the innermost intermediate cutter having an inner edge the same distance from the center of the stem as the inner cutter, and an outer edge that is the same distance from the center of the stem as the midpoint of the next outward intermediate cutter, each succeeding intermediate cutter having an outer edge the same distance from the center of the stem as the midpoint of the next outward intermediate cutter, the outermost intermediate cutter having an outer edge that is the same distance from the center of the stem as the outer edges of the gage cutters, the inner and gage cutters being substantially identical.

7. A raise drill reamer adapted for drilling a bore in earth formations by being rotated and drawn upward by a string of drill pipe extending through a pilot hole, comprising in combination:

a cutter support member having a stem secured to its center of rotation and extending upwardly for connection to the string of drill pipe;

an inner cutter rotatably mounted to the cutter support member adjacent the stem, and having a plurality of hard metal inserts for disintegrating the earth formation face in the vicinity of the pilot hole;

a plurality of gage cutters rotatably mounted to the cutter support member at the periphery, each having a plurality of hard metal inserts for disintegrating the earth formation face in the vicinity of the gage;

a plurality of intermediate cutters rotatably mounted between the inner cutter and the gage cutters at regular intervals, each having a plurality of hard metal inserts for disintegrating the earth formation face in the vicinity between the pilot hole area and the gage area; each intermediate cutter being divided vertically substantially at its midpoint into an outer portion and an inner portion, both of which are frustoconical surfaces tapering inwardly, the inclination of the inner portion being at a greater degree of inclination than the outer portion with respect to the cutter axis of rotation; the pattern of the inserts on the inner portion being different than the pattern of the inserts of the outer portion;

the inner cutter, gage cutters, and inner and outer portions of each intermediate cutters each defining an annular path as they are rotated by the drill stem, the inner cutter and the gage cutters being identical and defining a path the width of the path of one of the portions of the intermediate cutters, the inner portion of the innermost intermediate cutter fully overlapping the path of the inner cutter, the outer portion of the innermost intermediate cutter fully overlapping the path of the inner portion of the next outward intermediate cutter, the outer portion of each succeeding intermediate cutter fully overlapping the path of the inner portion of the next outward intermediate cutter, the outer portion of the outermost intermediate cutter fully overlapping the paths of the gage cutters.

8. An earth boring drill bit, comprising in combination:

a cutter support member adapted to be connected to a string of drill pipe for imparting rotary drive to the cutter support member;

at least one inner cutter mounted to the cutter support member adjacent the center for disintegrating the earth formation face in the vicinity of the center;

a plurality of gage cutters mounted at the periphery of the cutter support member, all of the gage cutters being located the same distance from the center of the cutter support member; each gage cutter having a smooth circumferential surface but for a single sharp circumferential ridge, located on the outer edge, for disintegrating the earth formation face in the vicinity of the gage;

a plurality of intermediate cutters mounted to the cutter support member between the inner cutter and the gage cutters at regular intervals, each having a smooth circumferential surface but for a single sharp circumferential ridge in the center of the cutter for disintegrating the earth formation face; the outer edge of each intermediate cutter being located at the same distance from the center of the cutter support member as the ridge on the next outward intermediate cutter, the ridge of the outermost intermediate cutter being located the same distance from the center of the cutter support member as the inner edge of the gage cutters, the gage cutters being one-half the width of the intermediate cutters, thereby placing cutting ridges at a spacing that is one-half the width of the cutters.

* * * * *

UNITED STATES PATENT OFFICE

CERTIFICATE OF CORRECTION

Patent No. 4,248,314 Dated February 3, 1981

Inventor(s) ROBERT ASHLEY CUNNINGHAM & RUDOLF C. O. PESSIER

It is certified that error appears in the above-identified patent and that said Letters Patent are hereby corrected as shown below:

Column 3, line 43, after "21", insert -- (Fig. 2) --.

Column 6, line 46, delete "inert" and insert therefor -- insert --,

Signed and Sealed this

*Sixteenth* Day of *June 1981*

[SEAL]

*Attest:*

RENE D. TEGTMEYER

*Attesting Officer*

*Acting Commissioner of Patents and Trademarks*